US006256456B1

(12) United States Patent
DeSantis

(10) Patent No.: US 6,256,456 B1
(45) Date of Patent: Jul. 3, 2001

(54) HOT WATER DISPENSER WITH HEAT DISSIPATION PLATES FOR DRY-START PROTECTION

(75) Inventor: Paul M. DeSantis, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/479,190

(22) Filed: Jan. 7, 2000

Related U.S. Application Data

(63) Continuation-in-part of application No. 09/396,387, filed on Sep. 15, 1999, which is a continuation-in-part of application No. 09/026,070, filed on Feb. 19, 1998, now abandoned.

(51) Int. Cl.[7] ..... H05B 3/78; F24H 1/20

(52) U.S. Cl. ..... 392/452; 392/455; 392/501; 219/536; 220/651; 220/688

(58) Field of Search ..... 392/441, 447, 392/449, 451, 452, 455, 497, 501, 444, 448; 126/345, 348; 219/228, 481, 520, 531, 536, 538, 548; 220/4.12, 4.13, 646, 651, 688

(56) References Cited

U.S. PATENT DOCUMENTS

| | | | | |
|---|---|---|---|---|
| 3,642,176 | | 2/1972 | Dreibelbis et al. | 222/146 HE |
| 3,793,934 | | 2/1974 | Martin | 99/282 |
| 3,836,050 | | 9/1974 | Dreibelbis | 222/66 |
| 3,891,124 | | 6/1975 | Dreibelbis | 222/66 |
| 3,905,518 | | 9/1975 | Dreibelbis et al. | 222/146 HE |
| 3,927,802 | | 12/1975 | Lavochkin et al. | 222/67 |
| 4,263,498 | | 4/1981 | Meyers | 219/312 |
| 4,354,094 | | 10/1982 | Massey et al. | 219/306 |
| 4,425,660 | * | 1/1984 | Jones | 373/130 |
| 4,455,477 | | 6/1984 | Massey et al. | 219/328 |
| 4,513,887 | | 4/1985 | Wicke et al. | 222/146.5 |
| 4,687,905 | * | 8/1987 | Cunningham et al. | 392/451 |
| 5,103,859 | | 4/1992 | Martin et al. | 137/448 |
| 5,692,096 | | 11/1997 | Massey et al. | 392/464 |
| 5,703,998 | * | 12/1997 | Eckman | 392/340 |
| 6,009,238 | * | 12/1999 | Belongia | 392/444 |
| 6,028,294 | * | 2/2000 | Nilson | 219/523 |

FOREIGN PATENT DOCUMENTS

| | | | |
|---|---|---|---|
| B-64500/90 | 4/1991 | (AU) . | |
| B-65827/90 | 5/1991 | (AU) . | |
| B-80474/94 | 6/1995 | (AU) . | |
| 19636143 | 10/1997 | (DE) | F24H/9/02 |
| 0790411 | 8/1997 | (EP) | F15B/1/12 |
| 2 065 848A | 7/1981 | (GB) . | |
| WO 9934153 | 7/1999 | (WO) . | |

* cited by examiner

*Primary Examiner*—Teresa Walberg
*Assistant Examiner*—Thor S Campbell
(74) *Attorney, Agent, or Firm*—Howrey Simon Arnold & White, LLP

(57) ABSTRACT

The present invention presents a heat dissipating system for protecting a hot water tank dispenser from damage during a dry operation. The dispenser includes a hot water tank with a plastic wall. The hot water tank contains a heating element extending through a plurality of bushings mounted to the plastic wall. The heat dissipating system comprises at least one heat dissipation plate mounted to the plastic wall by the bushing and isolated from the heating element by the bushing.

24 Claims, 4 Drawing Sheets

HOT WATER DISPENSER WITH HEAT DISSIPATION PLATES FOR DRY-START PROTECTION

CROSS-REFERENCE TO RELATED APPLICATIONS

This application is a continuation-in-part of U.S. patent application Ser. No. 09/396,387, filed Sep. 15, 1999, which is a continuation-in-part of U.S. patent application Ser. No. 09/026,070, filed Feb. 19, 1998 now abandoned.

FIELD OF INVENTION

The present invention relates generally to a plastic hot water heating tank including a system for protecting low temperature materials during accidental dry operation. In particular, the present invention relates to a plastic hot water dispensing tank with heat dissipation plates to ensure the safety and durability of the plastic tank walls.

BACKGROUND OF THE INVENTION

The use of systems for heating and dispensing hot water is known in the market place. As used herein, "hot water" refers to water at temperatures at or about 190° Fahrenheit (88° Celsius), but below the boiling point of water (212° Fahrenheit/100° Celsius). Water at this high temperature can be made available at a dedicated faucet for users needing hot water to make, for example, coffee, tea, or cocoa. A typical preexisting, system heats water in a relatively small tank that is situated below the sink on which the dedicated faucet is mounted. The tank may have a capacity of ⅓ or ½ gallons (1.3 or 1.9 liters). Such tanks are usually divided into two chambers, a main chamber and an expansion chamber. Water is heated electrically in the main chamber. The expansion chamber is contiguous with the main chamber and contains water that is initially heated in the main chamber and allowed to expand into the expansion chamber to preclude pressure buildup generated by heating the water.

Most known water heating chambers and tanks utilize metal fabricating wherein several pieces of metal must be integrated together to create separate air and watertight chambers. This metal construction is labor intensive, requires expensive cleaning operations during fabrication and is susceptible to leaks. As a result, a hot water dispenser with a plastic tank construction was developed and is the subject of application Ser. Nos. 09/396,387, and 09/026,070, which are incorporated herein by reference in their entirety. Tanks that are not comprised of metal, however, are less able to sufficiently withstand heat produced during an accidental dry operation, which happens when the heating element is activated after installation of the tank and before water has been introduced into the system. Accordingly, a need exists for a heat dissipating system that allows a plastic water-heating tank of a hot water dispenser to survive an accidental dry operation.

SUMMARY OF THE INVENTION

The present invention provides a heat dissipating system for protecting a hot water tank dispenser from damage during a dry operation. The dispenser includes a plastic-walled hot water tank containing a heating element extending through a plurality of bushings mounted to the plastic wall. The heat dissipating system also comprises at least one heat dissipation plate mounted to the plastic walls by a bushing and isolated from the heating element by the bushing.

BRIEF DESCRIPTION OF THE DRAWINGS

The foregoing and other advantages of the invention will become apparent upon reading the detailed description as follows and upon reference to the drawings in which.

Figure 1:
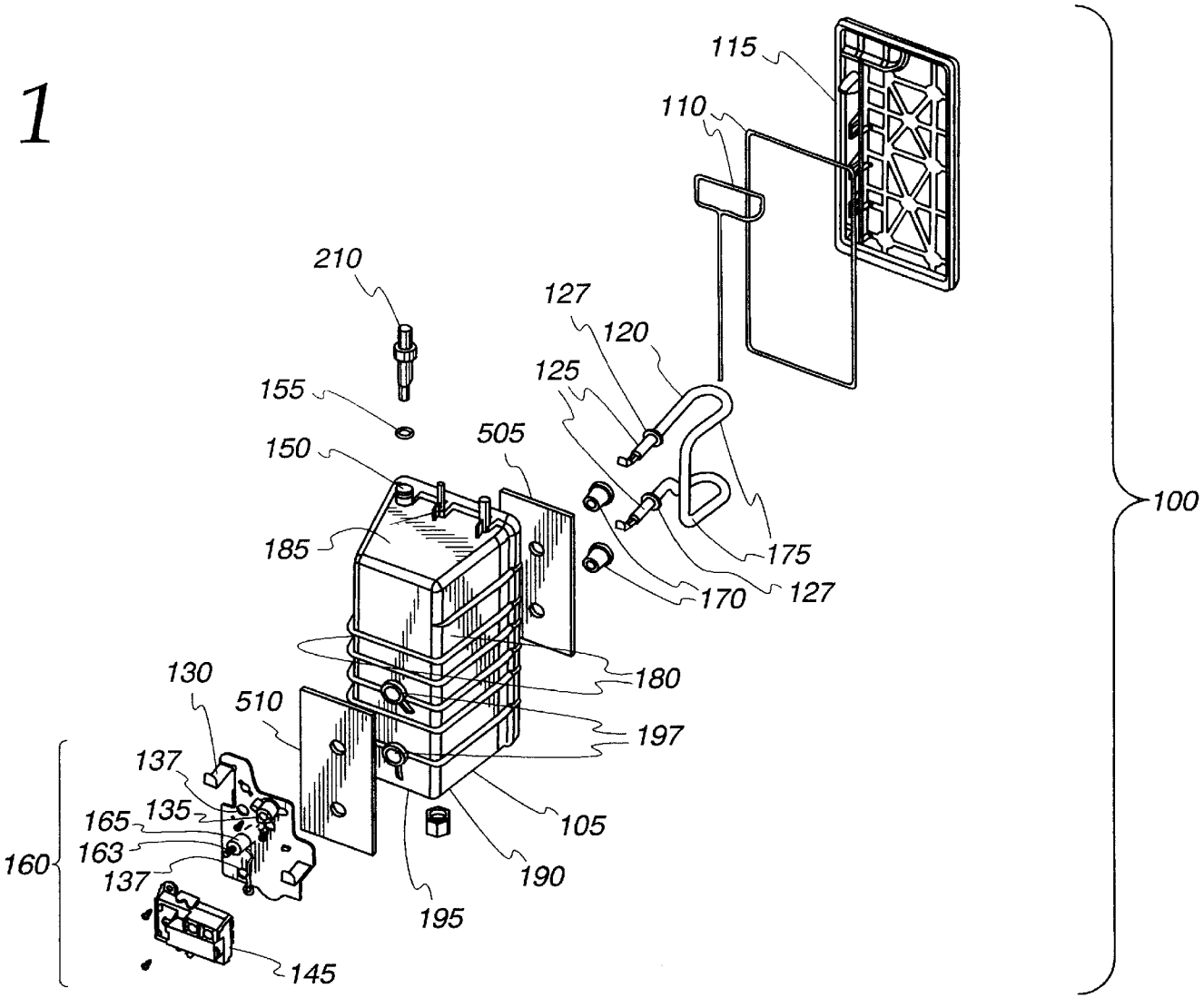
FIG. 1 is an exploded view of a heating tank assembly of the hot water dispensing system.

While the present invention is susceptible to various modifications and alternative forms, two specific embodiments thereof have been shown by way of example in the drawings and will herein be described in detail. It should be understood, however, that it is not intended to limit the invention of the particular forms disclosed, but on the contrary, the intention is to cover all modifications, equivalents and alternative falling within the spirit and scope of the invention as defined by the appended claims.

DESCRIPTION OF ILLUSTRATIVE EMBODIMENTS

FIG. 1 depicts an exploded view of heating tank assembly 100. The heating tank assembly includes, among other things: a tank body 105, Emaweld® strands 110 and 155, a tank cover 115, a heating element 120, a temperature control system 160, a venturi valve 210, and inner and outer heat dissipation plates 505 and 510, respectively.

The tank body 105 is formed from a plastic material and is comprised of two side walls 180, a top wall 185, a bottom wall 190 and a rear wall 195 containing two orifices 197. The design of one embodiment of the present invention is described as a one-piece plastic tank construction. Each tank chamber, the venturi valve and all inlet/outlet ports are all injection molded using conventional techniques and preferably composed of plastic. The one-piece plastic molded configuration of one embodiment of the present invention greatly reduces the cost and labor required to make the tank as well as significantly reducing the potential for leaks. The plastic tank is considered to be one-piece after a tank cover 115 and a venturi valve 210 are integrally heat bonded to the five-sided tank body 105 using an Emabond® electromagnetic welding system. The Emabond® welding system is commercially available from the Ashland Chemical Company of Columbus, Ohio.

The Emabond® welding system utilizes ferromagnetic material called Emaweld® that is placed between the tank body 105 and the tank cover 115. The Emaweld® sections 110 and 155 are spaghetti-type bonding strands that are subjected to alternating magnetic fields. These magnetic fields cause the Emaweld® sections 110 to melt and fuse the tank body 105 to the tank cover 115, creating structural, hermetic, pressure-tight and leak-proof seals. The heat-bonded tank cover 115 eliminates the need for a sealing system with additional materials and components, i.e, fasteners, sealing materials, etc. Similarly, the venturi valve 210 is fused to the tank body via use of an Emaweld® section 155. The elimination of metal components from the construction of the plastic tank further reduces heat loss from the water through the high heat conductivity of metal.

The plastic tank body 105 can be vulnerable to damage or deformation caused by an accidental dry tank operation, defined as the operation of a heating element 120 after installation of the tank but before the introduction of water into the tank. The water temperature within the plastic tank of one embodiment of the present invention is controlled by a thermostat attached to a metal temperature bracket 130 connected to a metal sheath 175 of a heating element 120. During normal tank operation, the plastic tank body 105 is insulated from the heat produced within the tank by cylindrical bushings 170. The bushings 170 must be composed of a low heat conductive material such as rubber or preferably, silicone, that is not a good conductor of heat, (i.e., the bushings 170 do not conduct heat as well as the metal temperature bracket 130) yet can act as an insulator of heat and additionally a seal.

When the heating element 120 is accidentally activated before the introduction of water into the heating tank, heat is conducted initially to the metal thermostat bracket 130. When the metal temperature bracket 130 becomes saturated with heat, the remaining heat will traverse through the silicone cylindrical bushings 170 and be diverted into the heat dissipation plates 505 and 510 because the heat dissipation plates 505 and 510 are in contact with the silicone bushings 170 and conduct heat better than the plastic walls of the tank body 105. The heat dissipation plates 505 and 510, formed from, for example, brass or copper, a metal or composite with better heat conductive properties than plastic, intercept the heal coming through the silicone cylindrical bushings 170 and carry the heat away from the plastic walls of the tank, significantly decreasing the likelihood of damage or deformation to the walls of the tank.

As shown in FIG. 1, before the tank cover 115 is heat bonded to the tank body 105, as described above, the silicone cylindrical bushings 170, the heating element 120 and the inner heat dissipation plate 505 are inserted. The silicone cylindrical bushings 170 are inserted into the two orifices of the inner heat dissipation plate 505 and then into the two orifices 197 in the rear wall 195 of the tank body 105. A metal washer 127 is attached to each arm 125 of the heating element 120. The two arms 125 of the heating element 120 are inserted into and extend through the silicone cylindrical bushings 170 until the metal washers 127 prevent further passage of each arm 125 of the heating element 120 through the silicone cylindrical bushings 170.

Because the tank body 105 is of plastic construction, a unique system for sensing the water temperature inside the water-heating chambers is also provided. A metal temperature sensing bracket 130 is located on the outside of the tank body 105 and is crimped to the two arms 125 of the heating element 120 as described below. It has been contemplated in accordance with the present invention that the temperature bracket 130 may be composed of copper or a composite of various metals. After the two arms 125 of the heating element 120 extend through the two orifices 197 in the rear wall 195, the two arms 125 extend through corresponding orifices of the outer heat dissipation plate 510. The two arms 125 subsequently reach through the two corresponding orifices 137 of the temperature bracket 130.

Figure 5:
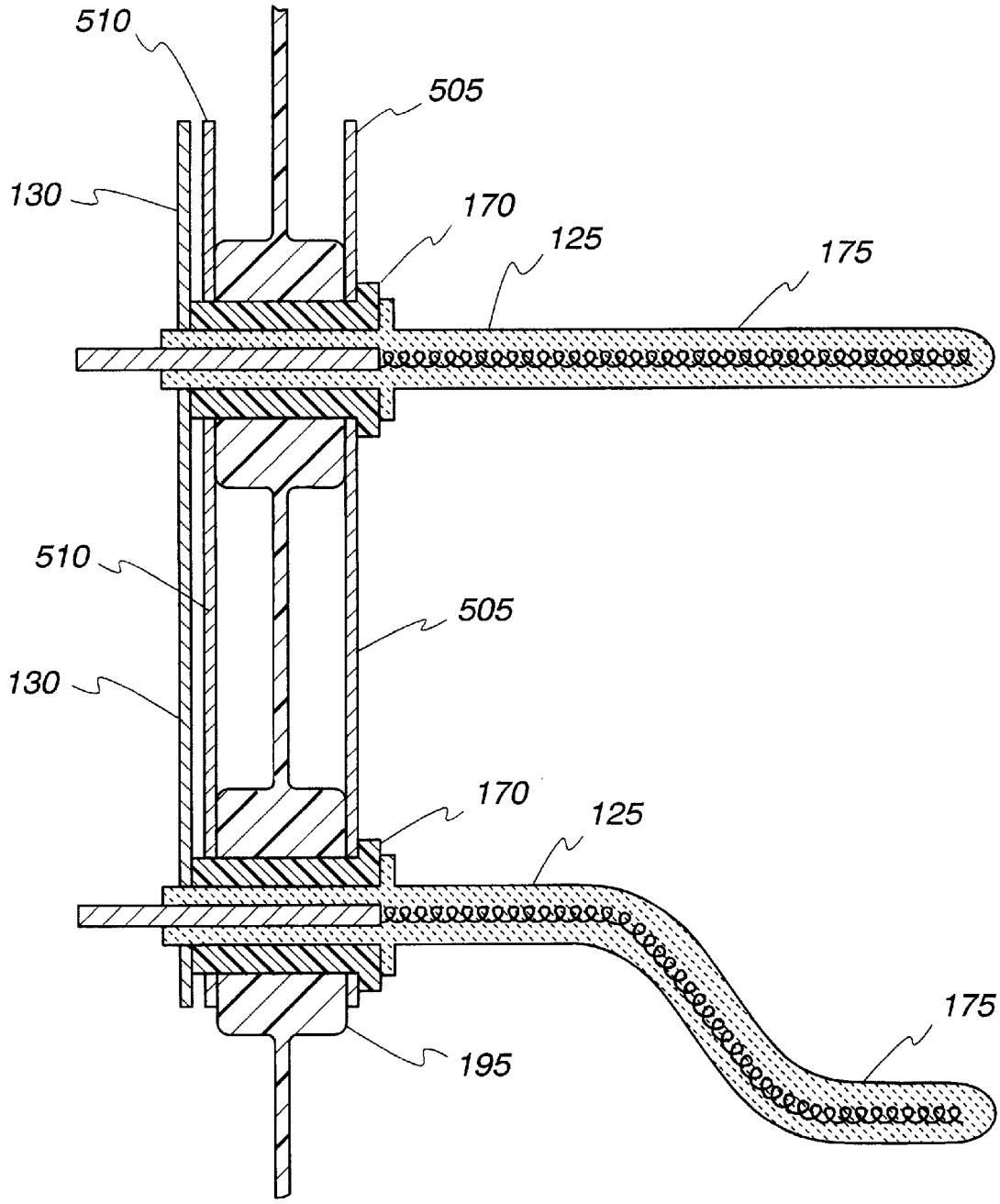
FIG. 5 is a cross-sectional view of the rear wall and heat dissipation plates of FIG. 1.

A sheath 175, as shown in FIGS. 1 and 5, is the outer covering of the entire heating element 120 and is composed of heat-conducting metal. The sheath is composed of metal to assist the temperature control system 160 in responding quickly to changes in the water temperature within the tank body 105. A crimping machine (not shown) crimps the outside of the two orifices 137 of the temperature bracket 130 onto the sheath portion 175 at the end of the two arms 125 of the heating element 120 to secure the temperature bracket 130 and the tank body 105 to the heating element 120. Crimping the orifices 137 of the temperature bracket 130 to the heating element 120 ensures a good metal connection between the temperature bracket 130 and the sheath 175. Because the temperature bracket 130 and the sheath 175 are excellent heat conductors, the temperature bracket 130 is able to detect changes in the water temperature through the heating element 120. A good connection between the temperature bracket 130 and the sheath 175 is needed to ensure that a thermostat 145 can accurately calculate and control the temperature of the water on the inside of the tank. The thermostat 145 is attached to the temperature bracket 130. A sensor at the bottom of the thermostat 145 senses the temperature of the temperature bracket 130 that correlates with the water temperature inside the tank body 105. This allows the use of a common, low cost thermostat. One example is a commercially available cycling thermostat from Therm-O-Disc, Inc., of Mansfield, Ohio. Typically, the thermostat 145 will maintain the water temperature inside the tank body 105 at around 190° Fahrenheit (88° Celsius), but always below the boiling temperature (212° Fahrenheit, 100° Celsius) of water.

Figure 4:
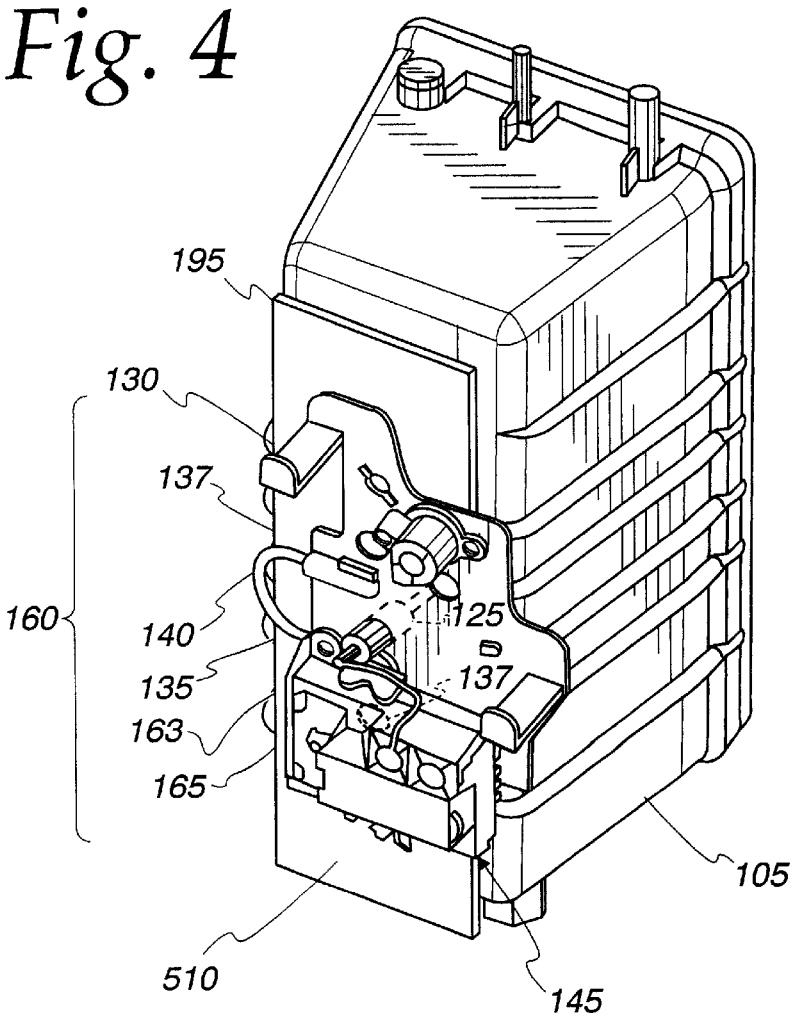
FIG. 4 is an assembly view of the temperature sensing system of the hot water dispensing system.

As shown in FIG. 4, a small tube 163 extends from each orifice 137 of the temperature bracket 130 (only one tube shown). A cold pin 165 extends from a position exterior to the tube 163, through the tube 163 and into the inside of the heating element 120. It is preferable that the cold pin 165 extends from about 0.5 inches to about 1.5 inches past the tube 163 and into the heating element 120 and more preferable that the cold pin extends about 1.0 inches past the tube 163 and into the heating element 120. A heater wire (not shown) within the heating element 120 on the interior of the tank body 105 is connected to the end of the cold pin 165 that extends into the heating element 120, as described above. It is contemplated in accordance with the present invention that the heater wire can be welded or crimped to the end of the cold pin 165.

When the temperature drops below a certain preset level, the thermostat 145 (via a wire connecting the thermostat 145 and the cold pin 165) directs a flow of current through the cold pin 165 and into the heater wire within the heating element 120. The current flows through the wire within the heating element 120 and exits at the cold pin at the other arm 125 of the heating element 120. Due to the resistive characteristics of the wire, the current passing through the wire produces heat, which, in turn, causes the temperature of the heating element 120 to increase. This subsequently causes the temperature of the water inside the tank body 105 to increase.

A packing material is placed within the tube 163 to secure the heater wire and the cold pin 165 within the tube 163 and to insulate the heater wire from touching the walls of the heating element 120. The packing material is packed using a vibration method to tightly compress the packing material. It is contemplated in accordance with the present invention that an example of the packing material used within the tube is magnesium oxide in powder form. A sealing compound is placed outside the packing material to seal the packing material and retard the absorption of moisture. One example of the sealing material used in accordance with the present invention is silicone liquid.

The temperature bracket 130 also provides excellent temperature sensing to a thermal cutout device (TCO) 135. The TCO 135 is a limiting thermostat that protects the tank from abnormal conditions such as no or low water conditions in the tank by shutting off the heating element. The TCO 135 is mounted to the temperature bracket 130 and senses the temperature of the water in the same manner as the thermostat 145, as described above. The TCO 135, a conventional and low-cost temperature-sensing device, is noninvasive in that it eliminates the need to put yet another hole in the tank and provides a separate temperature sensor. Thus, a simpler design is created, further reducing the cost of the heating system. One example of the TCO 135 is a limiting bimetal disc thermostat commercially available from Therm-O-Disc, Inc., of Mansfield, Ohio. FIG. 4 is an assembled view of the temperature control system 160. A wire harness 140 allows the temperature control system 160 to obtain electrical power.

As described generally above and best shown in FIGS. 1 and 5, an inner heat dissipation plate 505 and an outer heat dissipation plate 510 are inserted adjacent to and on opposing sides of the rear wall 195 of the tank body 105 to prevent damage to the plastic tank walls during a dry tank operation. It is contemplated in accordance with the present invention that a single heat dissipation plate can protect the plastic wall from some damage from the heat, however, it is preferable that the hot water dispenser of the present invention possess two heat dissipation plates. If the heating element 120 is activated before the tank contains water, the thermal cutout device (TCO) 135 is designed to shut off the heating element 120 after the heating element is activated for a predetermined time. After the thermal cutout device (TCO) shuts off the heating element, the heater will continue to radiate residual heat. This residual heat is called overshoot heat. The maximum temperature of this overshoot heat determines the heat rating that the tank material must possess in order to allow for the safety and security of the tank and surrounding environment.

A high maximum overshoot heat temperature indicates a high heat rating, and thus, a tank material must be used to accommodate such a high rating. A preferable heating element of the present invention possesses 750 Watts (120 Volts) of power and produces a high maximum overshoot heat temperature. It is contemplated in accordance with the present invention that a heating element able to produce 1300 Watts of heat can also be used. The tank walls of the present invention are comprised of plastic, a material that does not have a remarkably high heat rating. If no protective material or surface were used, the wattage of the heater used with the plastic-walled tank would have to be limited in order to prevent the plastic tank from melting or otherwise deforming. It is preferred, however, that the entire capacity of the heating element is used, and thus, such a heating element will produce overshoot heat with a high temperature.

It has been determined that a plurality of heat dissipation plates will collect a majority of the overshoot heat and keep the heat away from the plastic walls of the tank. Because these heat dissipation plates disperse the heat radiating from the heating element, the plastic walls are subject to a much lesser amount of heat. This greatly reduces the likelihood of damage to the walls of the tank, and, thus, these walls can be formed from a less expensive material (i e., plastic) with a lower heating rating. It is contemplated in accordance with the present invention that the thickness of the heat dissipation plates 505 and 510 could be about 0.01 inches to about 0.1 inches. Furthermore, it is contemplated in accordance with the present invention that the inner and outer heat dissipation plates 505 and 510, respectively, could extend the entire surface area of opposing sides of the rear wall 197. Heat dissipation plates with large surface area and thickness will be able to dissipate a greater amount of heat than similar plates with smaller surface area and thickness.

Specifically, as shown in FIG. 5, inner and outer heat dissipation plates 505 and 510 are inserted on respective opposite sides of the rear wall 195 of the plastic tank body 105. The inner heat dissipation plate 505 is placed adjacent the inside of the rear wall 195 and the outer heat dissipation plate 510 is placed adjacent the outside of the rear wall 195 of the tank body 105. The silicone cylindrical bushings 170 are placed through orifices 197, as shown in FIG. 1, of first, the inner heat dissipation plate 505, the rear wall 195, and finally the outer heat dissipation plate 510. As shown in FIG. 5, the inner and outer heat dissipation plates 505 and 510, respectively, are held in place by the silicone bushings 170. The two arms 125 of the heating element 120 are subsequently inserted through the silicone cylindrical bushings 170. The temperature bracket 130 is then connected to the sheath 175 of the heating element 120. The outer heat dissipation plate 510 does not contact the temperature bracket 130.

During normal operation of the tank, (i.e., operation while the tank is full of water) the plastic walls are insulated from the heat by the silicone cylindrical bushings 170. Generally, a portion of the heat emanating from the heating element travels to the metal temperature bracket 130, while the remainder of the heat increases the temperature of the water. However, during a dry operation (i.e. operation of the heating element 120 before water has been initiated into the tank), a portion of the overshoot heat is conducted into the metal temperature bracket 130. After the metal temperature bracket is saturated with heat, a portion of the remaining overshoot heat passes through the silicone cylindrical bushings 170. The inner and outer heat dissipation plates 505 and 510 held in place by the silicone cylindrical bushings 170 intercept the heat coming through the silicone cylindrical bushings 170 (on the interior and exterior of the tank) and allow the overshoot heat to be kept away from the plastic walls of the tank. The inner and outer heat dissipation plates 505 and 510 do not interfere with the normal transfer of the heat to the temperature bracket 130 during normal operation of the hot water tank because the plates are not directly connected to the conductive metal path of the heat. The heat dissipation plates only absorb the heat conducted through the silicone cylindrical bushings 170 during a dry operation of the tank.

Figure 2:
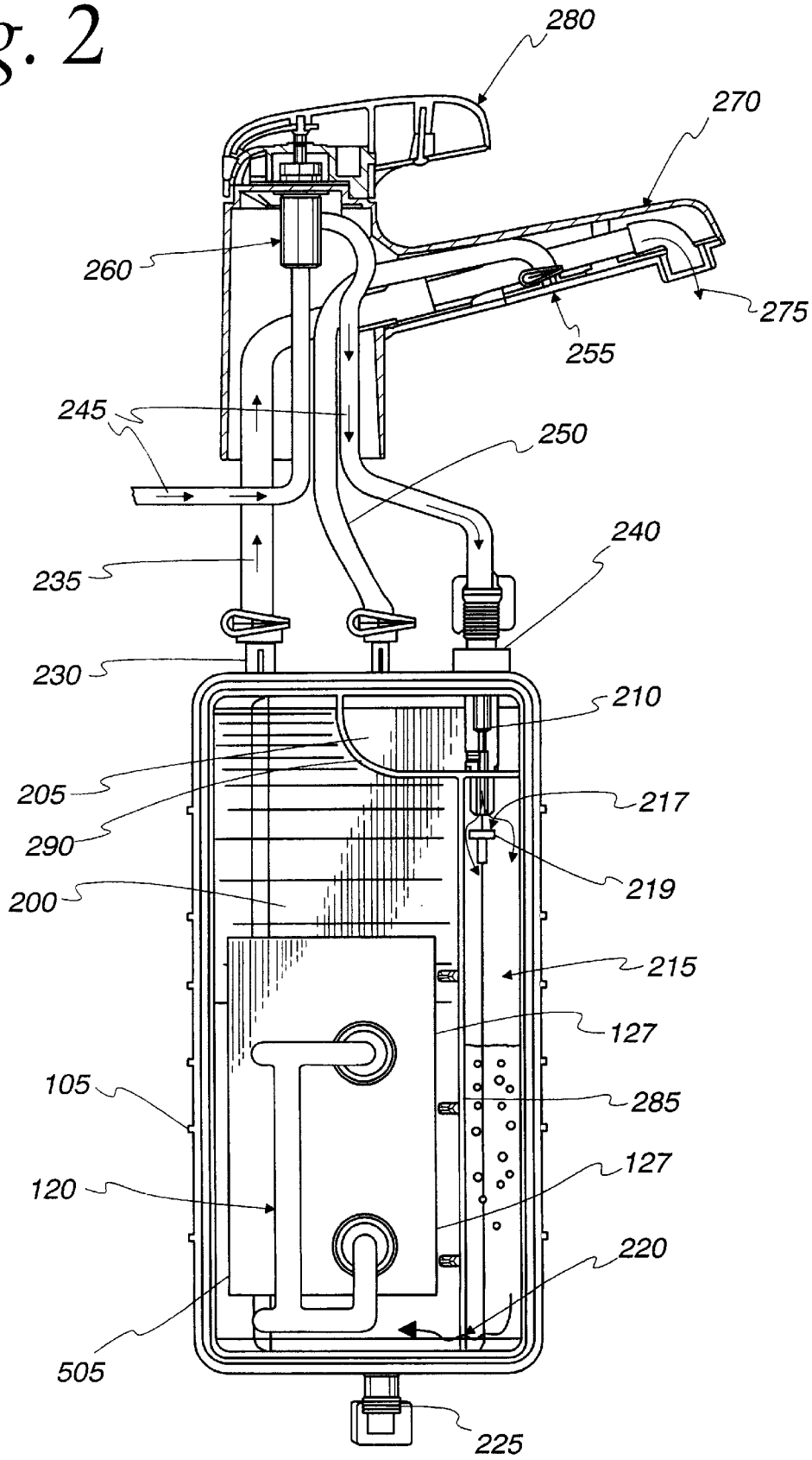
FIG. 2 is a cross-sectional view of an assembled hot water heating tank mounted to a dispensing faucet.

FIG. 2 depicts a cross-section of an assembled hot water dispensing system mounted to a dispensing faucet. The illustrated hot water dispensing system comprises a tank body 105 divided into a main heating chamber 200 and an expansion chamber 205 in fluid communication with and communicatively coupled to the main heating chamber 200. The tank body 105 includes an internal wall 285 separating the main heating chamber 200 from the air collection chamber 215 and another internal wall 290 separating the expansion chamber 205 from both the main heating chamber 200 and the air collection chamber 215. The bottom of the internal wall 285 includes an opening 220 to provide fluid communication between the main heating chamber 200 and the air collection chamber 215.

An undesirable feature of previously manufactured hot water dispensing systems arises when the water level in the expansion chamber drops to a level low enough for air to be drawn in through aspirator lateral hole(s) from the vented expansion chamber. In one embodiment of the present invention, the air collection chamber 215 is positioned within the tank body 105, residing generally below the expansion chamber 205 and adjacent to the main heating chamber 200. The incoming water supply line 245 provides water at line pressure to the plastic venturi valve 210 located within the expansion chamber 205 whenever a user actuates the operating handle 280 of the hot water faucet 270. Arrows in FIG. 2 indicate the flow direction of the water.

The venturi valve 210 directs entering water into the top 217 of the air collection chamber 215. The venturi valve is positioned within the expansion chamber 205 and is embedded to the tank through use of the previously described Emabond® welding system. Specifically, in one embodiment of the present invention, the tank body 105, as shown in FIG. 1, comprises an orifice 150 with a vertical rim extending away from the orifice 150. The venturi valve 210 is placed through the orifice 150 and situated within the expansion chamber 205, as shown in FIG. 2. After the venturi valve 210 is inserted, a flange of the venturi valve 210 is disposed around the vertical rim of the orifice 150, creating a pocket between the flange of the venturi valve 210 and the vertical rim of the orifice 150. Referring back to FIG. 1, an Emaweld® section 155 is installed within this pocket to embed the venturi valve 210 integral to the tank.

Referring to FIG. 2, in order to obtain hot water for consumption, a user actuates the operating handle 280 of the faucet 270. A supply line infeed valve 260 of the faucet is opened and closed by actuating an operating handle 280 of the faucet 270. It is contemplated in accordance with the present invention that user-initiated raising, pushing or turning can actuate the operating handle 280. Actuating the operating handle 280 causes water to be fed into the incoming water supply line 245, through the tank inlet 240 and into the venturi valve 210 located within the expansion chamber 205. Water in the main heating chamber 200 is heated by the heating element 120 and allowed to expand into the expansion chamber 205 through the venturi valve 210 and subsequently, the lateral hole 320 during times when water is being heated and expanded. It is contemplated in accordance with the present invention that more than one lateral hole may exist on the venturi valve 210. Water from the main heating chamber 200 does not expand into the expansion chamber 205 when water from the incoming water supply line 245 is traversing the venturi valve 210.

After water enters the venturi valve 210 from the incoming water supply line 245, negative pressure develops in the venturi valve 210 relative to the pressure in the expansion chamber 205. The negative pressure in the venturi valve 210 causes aspiration of hot water from the expansion chamber 205 into the air collection chamber 215. A jet stream mixture of hot water from the expansion chamber 205 and cold water from the incoming water supply line 245 is then projected from the venturi valve 210 into the top of the air collection chamber 215. When the expansion chamber 205 is emptied of water, air begins to be aspirated from the expansion chamber 205. Because air is lighter than the water, air is captured in the air collection chamber 215. Any air collected in the air collection chamber 215 is subject at its lower opened end to hydrostatic pressure from the water. The air collection chamber 215 can be filled sufficiently deep with air at a pressure that will balance against the water pressure in the tank.

As the collected air in the air collection chamber 215 pushes against the weight of the water in the tank, a positive pressure develops in the air collection chamber 215 and counters a vacuum pressure that develops in the venturi valve 210. The aspiration of air from the expansion chamber 205 slowly decreases with the increasing air pressure in the air collection chamber 215. The aspiration of air ceases when the air pressure in the air collection chamber 215 equals the vacuum pressure in the venturi valve 210. Water from the incoming water supply line 245 will still be fed into the venturi valve 210 as long as the faucet valve remains open.

After the water from the incoming water supply line 245 and the expansion chamber 205 is forced into the air collection chamber 215 through the venturi valve, the water arrives at the main heating chamber 200 via an opening 220 at the lower end of the air collection chamber 215. Hot water is then forced out of the main heating chamber 200, through the hot water line 235 and into the faucet 270 for consumer usage. The minimum square surface area of the water within the air collection chamber 215 is important. The square surface area of the water in the air collection chamber 215 is indirectly related to the amount of pressure required in the air collection chamber 215 and into the main heating chamber 200. The smaller the square surface area of the water, the greater the pressure that is required to force water out of the expansion chamber 205.

The air collection chamber 215 is located below the level of the expansion chamber 205 and is communicatively coupled to the main heating chamber 200. In one embodiment of the present invention, the air collection chamber 215 is rectangular and narrow relative to the main heating chamber 200. It is contemplated in accordance with the present invention that the air collection chamber 215 can be cylindrical or any other shape that would permit the passage of water as described in the present invention. It is also contemplated that the air collection chamber 215 could be about the same size or larger than the main heating chamber 200.

It is foreseeable but undesirable for the venturi jet velocity pressure to be extreme enough to drive collected air out of the bottom of the air collection chamber 215 and into the main heating chamber 200. This action is precluded in cases where such action could occur by installing a plastic deflector baffle 219 proximate to the exit end 340 of the venturi valve 210. The plastic deflector baffle 219 is arranged such that the venturi jet of water from the exit end 340 of the venturi valve 210 impinges upon the plastic deflector baffle 219 to dissipate the kinetic energy of the water and prevent air from exiting the air collection chamber 215 through the opening 220 at the bottom of internal wall 285. After impinging upon the plastic deflector baffle 219, the air and water separate. Without the baffle, air exiting the air collection chamber 215 and entering the main heating chamber 200 would rise to the top of the main heating chamber and bubbles of air would dispense with the outflowing hot water and produce undesired spitting and surging of air bubbles intermixed with the hot water exiting the main heating chamber 200 for consumer use. Instead of exiting the tank from the main heating chamber 200, air in the air collection chamber 215 must remain in the air collection chamber 215 to provide the necessary counterpressure to prohibit further aspiration of air from the expansion chamber 205. The plastic deflector baffle 219 of the present invention ensures that air will not depart from the air collection chamber 215 and enter the main heating chamber 200.

Maintaining the proper distance 335 between the exit end 340 of the venturi valve 210 and the plastic deflector baffle 219 will ensure an elimination of air bubbles in water leaving the tank for consumer usage. If the distance 335 from the exit end 340 of the venturi valve 210 to the plastic deflector baffle 219 is too small, water exiting the venturi valve 210 will bounce back at itself and change the aspiration pressure in the venturi valve 210. If the distance 335 is too large, the water exiting the venturi valve 210 will travel around the plastic deflector baffle 219 and render the baffle ineffective. The distance 335 from the exit end 340 of the venturi valve 210 to the plastic deflector baffle 219 is preferably from about 0.1 inches to about 0.8 inches, more preferably from about 0.2 inches to about 0.4 inches, and most preferably about 0.25 inches. In one embodiment of the present invention, the plastic deflector baffle 219 is mounted in the air collection chamber 215 with bypass openings around the plastic deflector baffle 219 so the jet stream water can flow into the main heating chamber 200. By way of example and not limitation, the pressure may be 3 psi in the air collection chamber 215 and 3.1 psi at the top 217 of the air collection chamber 215.

Water enters from the incoming water supply line 245 and continues through a supply line infeed valve 260, through the tank inlet 240 and into the main heating chamber 200. Hot water is delivered to the spout outlet 275 of the faucet 270 from the upper region of the main heating chamber 200 by way of the tank outlet 230 and subsequently the hot water line 235 which leads from the tank outlet 230 to the hot water spout outlet 275. The expansion chamber 205 is vented to the atmosphere by way of a tube 250 whose lower end is exposed to the interior of the expansion chamber 205 and whose upper end is opened to the atmosphere through the interior vent 255 of the faucet 270. In addition to preventing pressure above atmospheric pressure from developing in the expansion chamber 205, venting prevents a buildup of pressure in the main heating chamber 200, as discussed below. The tank has a conventional draining device 225.

If a user draws no hot water from the tank for an extended period of time, the water in the main heating chamber 200 and the expansion chamber 205 will be substantially evenly heated. When hot water is drawn from the tank it must necessarily be replenished with cold supply water. This allows a new heating cycle inflow of cold supply water to the tank from the incoming water supply line to effectuate an emptying of the expansion chamber 205 of water to provide a volume for incoming cold supply water to expand into as it is heated. Admitting replenishment supply water concurrently with emptying of the expansion chamber 205 is accomplished with a venturi valve 210. This venturi valve is shown in FIG. 2 and enlarged in FIG. 3.

Figure 3:
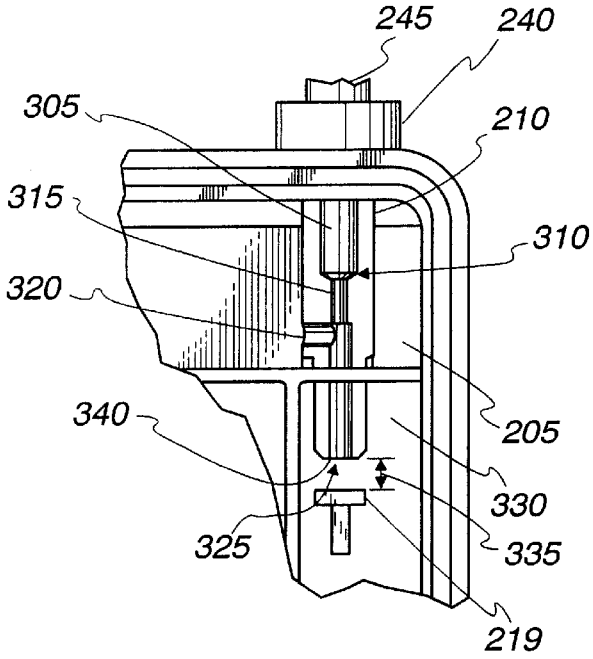
FIG. 3 is an enlarged view of a venturi valve aspirator of the hot water dispensing system.

As shown in FIG. 3, the venturi valve 210 is mounted in the expansion chamber 205. Cold supply water flows through the incoming water supply line 245 and through a bore 305 of the venturi valve. This cold supply water imposes pressure on the inlet 310 of a venturi orifice 315. Restricting the flow of the water by way of the small diameter orifice 315 results in a velocity increase in the orifice, and as a result a jet of water emerges from the exit end 325 of the orifice. Consonant with Bernoulli's principle, the increase in velocity in the orifice is accompanied by a decrease in water pressure relative to the pressure of the hot water in the expansion chamber 205. Hot water initially arrives at the expansion chamber 205 by expanding from the main heating chamber 200. Consequently, hot water from the expansion chamber 205 is drawn into the jet stream through the lateral hole 320 of the venturi valve 210, as described above. The stream of mixed hot and cold water, when discharged from the exit end 325 of the orifice, is at a pressure well below supply line pressure but is still sufficiently high to force hot water out of the main heating chamber 200, through the tank outlet 230 and into the hot water line 235 for subsequent user consumption.

While the present invention has been described with reference to the particular embodiments illustrated, those skilled in the art will recognize that many changes and variations may be made thereto without departing from the spirit and scope of the present invention. The embodiments and obvious variations thereof are contemplated as falling within the scope and spirit of the claimed invention, which is set forth in the following claims:

What is claimed is:

1. A heat dissipating system for protecting a hot water tank dispenser from damage during dry operation, said dispenser including a hot water tank with a plastic wall, said hot water tank containing a heating element extending through a bushing mounted to said plastic wall, said heat dissipating system comprising at least one heat dissipation plate mounted to said plastic wall by said bushing and isolated from said heating element by said bushing.

2. The heat dissipating system of claim 1, wherein said bushing is comprised of a low heat conductive material selected from a group consisting of silicone and rubber.

3. The heat dissipating system of claim 1, wherein said heat dissipation plate is comprised of a conductive metal selected from a group consisting of copper and brass.

4. The heat dissipating system of claim 1, wherein said at least one heat dissipation plate includes two heat dissipation plates.

5. The heat dissipating system of claim 4, where said heat dissipation plates are disposed on opposing sides of said wall of said tank.

6. The heat dissipating system of claim 1, wherein at least a portion of heat from said heating element is intercepted by said at least one heat dissipation plate when said heating element is activated before water is introduced into said heat dissipating system.

7. The heat dissipating system of claim 1, wherein said hot water dispenser includes a temperature bracket mounted to said heating element and disposed outside said tank, wherein at least a portion of heat from said heating element that is normally transferred to said temperature bracket is intercepted by said heat dissipation plate when said heating element is activated before water is introduced into said heat dissipating system.

8. A hot water dispenser protected from damage during dry operation, comprising:

a hot water tank including a plastic wall and containing a heating element extending through a bushing mounted to said plastic wall; and at least one heat dissipation plate mounted to said plastic wall by said bushing and isolated from said heating element by said bushing.

9. The hot water dispenser of claim 8, wherein said tank includes a main heating chamber and an expansion chamber in fluid communication with each other, said heating element being located in said main heating chamber.

10. The hot water dispenser of claim 9, wherein said tank further includes an air collection chamber disposed generally below said expansion chamber and alongside said main heating chamber, said main heating chamber being in fluid communication with said expansion chamber and said air collection chamber.

11. The hot water dispenser of claim 8, wherein said bushing is comprised of a low heat conductive material selected from a group consisting of silicone and rubber.

12. The hot water dispenser of claim 8, wherein said dissipation plate is comprised of a conductive metal selected from a group consisting of copper and brass.

13. The hot water dispenser of claim 8, wherein said at least one heat dissipation plate includes two heat dissipation plates.

14. The hot water dispenser of claim 13, where said heat dissipation plates are disposed on opposing sides of said wall of said tank.

15. The hot water dispenser of claim 8, wherein at least a portion of heat from said heating element is intercepted by said at least one heat dissipation plate when said heating element is activated before water is introduced into said tank.

16. The hot water dispenser of claim 8, further including a temperature bracket mounted to said heating element and disposed outside said tank, wherein heat from said heating element is normally transferred to said temperature bracket when a level of water in said tank is above said heating element and wherein at least some of said heat is diverted to said heat dissipation plate when said heating element is activated before water is introduced into said tank.

17. A hot water dispenser protected from damage during dry operation, comprising:

a hot water tank including a plastic wall, said plastic wall containing a pair of orifices having respective bushings mounted therein, said tank containing a heating element having a pair of arms extending through said respective bushings; and a pair of heat dissipation plates mounted to said plastic wall by said bushings, said plates being disposed on opposite sides of said plastic wall such that one of said plates is disposed inside said tank and the other of said plates is disposed outside said tank, said plates being isolated from said heating element by said bushings.

18. The hot water dispenser of claim 17, wherein said tank includes a main heating chamber and an expansion chamber in fluid communication with each other, said heating element being located in said main heating chamber.

19. The hot water dispenser of claim 18, wherein said tank further includes an air collection chamber disposed generally below said expansion chamber and alongside said main heating chamber, said main heating chamber being in fluid communication with said expansion chamber and said air collection chamber.

20. The hot water dispenser of claim 17, wherein said bushings are comprised of a low heat conductive material selected from a group consisting of silicone and rubber.

21. The hot water dispenser of claim 17, wherein said heat dissipation plates are comprised of a conductive metal selected from a group consisting of copper and brass.

22. The hot water dispenser of claim 17, where said heat dissipation plates are disposed on opposing sides of said wall of said tank.

23. The hot water dispenser of claim 17, wherein at least a portion of heat from said heating element is intercepted by said at least one heat dissipation plate when said heating element is activated before water is introduced into said tank.

24. The hot water dispenser of claim 17, further including a temperature bracket mounted to said heating element and disposed outside said tank, wherein heat from said heating element is normally transferred to said temperature bracket when a level of water in said tank is above said heating element and wherein at least some of said heat is diverted to said heat dissipation plate when said heating element is activated before water is introduced into said tank.

* * * * *